US009044927B2

(12) United States Patent
Brudermann et al.

(10) Patent No.: US 9,044,927 B2
(45) Date of Patent: Jun. 2, 2015

(54) DOCTOR BLADE

(75) Inventors: Hans Jörg Brudermann, Zollikofen (CH); Sibylle Stiltz, Lotzwil (CH); Andreas Hugli, Heimiswil (CH)

(73) Assignee: Daetwyler SwissTech AG, Bleienbach (CH)

( * ) Notice: Subject to any disclaimer, the term of this patent is extended or adjusted under 35 U.S.C. 154(b) by 180 days.

(21) Appl. No.: 13/121,432

(22) PCT Filed: Aug. 27, 2009

(86) PCT No.: PCT/CH2009/000289

§ 371 (c)(1), (2), (4) Date: May 19, 2011

(87) PCT Pub. No.: WO2010/037240

PCT Pub. Date: Apr. 8, 2010

(65) Prior Publication Data

US 2011/0219971 A1 Sep. 15, 2011

(30) Foreign Application Priority Data

Sep. 30, 2008 (CH) ..... 1546/08

(51) Int. Cl.
*B41F 31/04* (2006.01)
*B41F 9/10* (2006.01)
*B41N 10/00* (2006.01)

(52) U.S. Cl.
CPC ..... *B41F 9/1072* (2013.01); *B41N 10/005* (2013.01)

(58) Field of Classification Search
CPC ..... B41F 31/04; B41F 9/1072; B41F 9/10; C23C 28/00; C23C 28/027; C23C 28/02; C23C 28/028
USPC ..... 101/169, 154, 157, 365, 350.1, 364, 101/350.6
See application file for complete search history.

(56) References Cited

U.S. PATENT DOCUMENTS 3,401,097 A * 9/1968 Merker et al. ..... 205/274
3,506,548 A * 4/1970 Duchene ..... 205/274

(Continued)

FOREIGN PATENT DOCUMENTS

CN 1625469 6/2005
CN 101160212 4/2008

(Continued)

OTHER PUBLICATIONS

Kurowski, Andre, "Elektrochemische und oberflachenanalytische Untersuchungen zur galvanischen und chemischen Nickel—Phospor Schichtbildung," Inaugural Dissertation, Dusseldorf 2003.

(Continued)

*Primary Examiner* — Jill Culler
*Assistant Examiner* — Leo T Hinze
(74) *Attorney, Agent, or Firm* — Jacox, Meckstroth & Jenkins

(57) ABSTRACT

A doctor blade for wiping printing ink off a surface of a printing plate, comprising a flat and elongated main body having a working edge region configured in a longitudinal direction, the working edge region being covered with a first coating on the basis of a nickel-phosphorus alloy applied by electroless deposition, and hard material particles being dispersed in the first coating, characterized in that the first coating is covered with a second coating on the basis of galvanically deposited nickel.

27 Claims, 1 Drawing Sheet

(56) References Cited

U.S. PATENT DOCUMENTS

Figure 1:
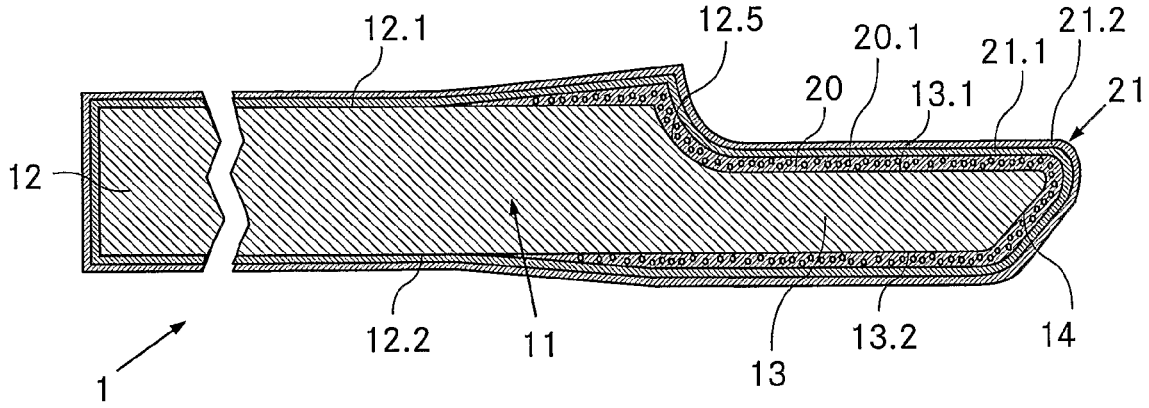

| | | | | |
|---|---|---|---|---|
| 3,940,319 | A * | 2/1976 | Pollack | 205/253 |
| 4,108,740 | A * | 8/1978 | Wearmouth | 101/348 |
| 5,947,021 | A | 9/1999 | Coleman et al. | |
| 6,841,264 | B2 | 1/2005 | Lunnerfjord et al. | |
| 7,152,526 | B2 | 12/2006 | Urata et al. | |
| 2002/0182437 | A1 * | 12/2002 | Adamou et al. | 428/679 |
| 2004/0137261 | A1 | 7/2004 | Lunnerfjord et al. | |
| 2005/0089706 | A1 | 4/2005 | Urata et al. | |
| 2007/0017392 | A1 * | 1/2007 | Filippini Fantoni et al. | 101/157 |
| 2009/0120355 | A1 | 5/2009 | Urata et al. | |

FOREIGN PATENT DOCUMENTS

| | | | |
|---|---|---|---|
| CN | 101235500 | | 8/2008 |
| EP | 0061093 | A1 | 9/1982 |
| EP | 1197584 | | 4/2002 |
| JP | 2952333 | | 9/1999 |
| WO | 0246526 | A1 | 6/2002 |
| WO | 03064157 | A1 | 8/2003 |
| WO | 2006112522 | | 10/2006 |

OTHER PUBLICATIONS

Wang Ling, Mei Tianqing, "Technology and Application for Senior Galvanizers," Jiangsu Science and Technology Publishing House, pp. 13-17, 132-135 and 239-243, Dec. 31, 2005.

* cited by examiner

DOCTOR BLADE

CROSS-REFERENCE TO RELATED APPLICATIONS

This application claims priority to PCT Application No. PCT/CH2009/000289 filed Aug. 27, 2009, and to Swiss Application No. CH1546/08 filed Sep. 30, 2008, which applications are incorporated herein by reference and made a part hereof.

BACKGROUND OF THE INVENTION

1. Field of the Invention

The invention relates to a doctor blade, in particular for doctoring off printing ink from a surface of a printing form, comprising a flat and elongated main body having a working edge region formed in a longitudinal direction, wherein the working edge region is covered with a first coating on the basis of an electrolessly deposited nickel-phosphorus alloy, and wherein hard material particles are dispersed in the first coating. Furthermore, the invention relates to a process for producing a doctor blade.

2. Description of the Related Art

In the printing industry, doctor blades are used, in particular, for wiping excess printing ink off the surfaces of printing cylinders and printing rolls. Particularly in the case of gravure printing and flexographic printing, the quality of the doctor blade has a decisive influence on the printing result. By way of example, instances of unevenness or irregularities in the working edges of the doctor blade that are in contact with the printing cylinder lead to incomplete wiping of the printing ink off the webs of the printing cylinders. This can result in uncontrolled release of printing ink on the printing substrate.

During the wiping-off operation, the working edges of the doctor blade are pressed onto the surfaces of the printing cylinders or printing rolls and are moved in relation thereto. Particularly in the case of rotary printing presses, the working edges are therefore subjected to high mechanical stresses, which are associated with corresponding wear. In principle, doctor blades are therefore consumable items, which have to be exchanged periodically.

Doctor blades are usually formed on the basis of a steel main body with a specially shaped working edge. In order to improve the service life of the doctor blade, it is possible for the working edges of the doctor blade to additionally be provided with coatings or coverings made of metals and/or plastics. Metallic coatings often contain nickel or chromium which, if appropriate, are present in a form mixed or alloyed with other atoms and/or compounds. In this respect, the material properties of the coatings have a significant influence on the mechanical and tribological properties of the doctor blade, in particular.

WO 2003/064157 (Nihon New Chrome Co. Ltd.), which is equivalent to U.S. Pat. No. 7,152,526, describes, for example, doctor blades for the printing sector, which have a first layer of chemical nickel with hard material particles dispersed therein and a second layer with low surface energy. The second layer preferably consists of a covering made of chemical nickel with fluorine-based resin particles or of a purely organic resin.

Although doctor blades coated in this way have an improved wear resistance compared to uncoated doctor blades, the service life is still not entirely satisfactory. In addition, it has been found that uncontrolled instances of streaking can arise, in particular in the run-in phase, when such doctor blades are used, and this is likewise undesirable.

Therefore, there is still a need for an improved doctor blade which, in particular, has a longer service life and, at the same time, makes optimum wiping off possible.

SUMMARY OF THE INVENTION

It is therefore an object of the invention to provide a doctor blade belonging to the technical field mentioned in the introduction, which has an improved wear resistance and makes accurate wiping off, in particular of printing ink, possible throughout its service life.

The object is achieved by utilizing a doctor blade comprising a flat and elongated main body having a working edge region formed in a longitudinal direction, wherein the working edge region is covered with a first coating on the basis of an electrolessly deposited nickel-phosphorus alloy, and wherein hard material particles are dispersed in the first coating, wherein the first coating is covered with a second coating on the basis of electrodeposited nickel. According to the invention, the first coating is covered with a second coating on the basis of electrodeposited nickel.

In this context, an electrolessly deposited nickel-phosphorus alloy, which forms the basis of the first coating, is understood to mean a mixture of nickel and phosphorus in which the phosphorus content is, in particular, 1-15% by weight. Such alloys are deposited electrolessly or without external current and are also referred to as chemical nickel. The expression "on the basis of an electrolessly deposited nickel-phosphorus alloy" means that the electrolessly deposited nickel-phosphorus alloy forms the main constituent part of the first coating. In this case, it is also possible by all means for the first coating to contain other types of atom and/or chemical compounds in addition to the electrolessly deposited nickel-phosphorus alloy, which are present in a smaller proportion than the electrolessly deposited nickel-phosphorus alloy. The proportion of the electrolessly deposited nickel-phosphorus alloy in the first coating is preferably at least 50% by weight, particularly preferably at least 75% by weight and very particularly preferably at least 95% by weight. Ideally, apart from unavoidable impurities, the first coating consists exclusively of an electrolessly deposited nickel-phosphorus alloy with hard material particles dispersed therein.

According to the invention, hard material particles include, in particular, metal carbides, metal nitrides, ceramics and intermetallic phases, which preferably have a hardness of at least 1000 HV. These include, by way of example, diamond (C), cubic boron nitride (BN), boron carbide (BC), chromium oxide ($Cr_2O_3$), titanium diboride ($TiB_2$), zirconium nitride (ZrN), zirconium carbide (ZrC), titanium carbide (TiC), silicon carbide (SiC), titanium nitride (TiN), corundum ($Al_2O_3$), tungsten carbide (WC), vanadium carbide (VC), tantalum carbide (TaC), zirconium dioxide ($ZrO_2$) and/or silicon nitride ($Si_3N_4$).

The expression "on the basis of electrodeposited nickel" means that the electrodeposited nickel, which is deposited with the aid of current from an electrolyte bath, forms the main constituent part of the second coating. In this case, it is also possible by all means for the second coating to contain other types of atom and/or chemical compounds in addition to the electrodeposited nickel, which are present in a smaller proportion than the electrodeposited nickel. In particular, it is also possible for a nickel alloy containing other types of atom and/or chemical compounds to be present. The proportion of the electrodeposited nickel in the second coating is preferably at least 50% by weight, particularly preferably at least 75% by weight and very particularly preferably at least 95% by weight.

In a first variant of the invention, the second coating is in particular substantially free of phosphorus. In this case, however, phosphorus can also be present in the second coating as an unavoidable impurity in very small amounts, in particular in a proportion of less than 0.1% by weight. Ideally, apart from unavoidable impurities, the second coating consists exclusively of electrodeposited nickel.

In a further advantageous variant of the invention, the second coating comprises an electrodeposited nickel-phosphorus alloy. In this context, an electrodeposited nickel-phosphorus alloy is accordingly understood to mean a mixture of nickel and phosphorus in which the phosphorus content is, in particular, 12-15% by weight and the remaining proportion preferably consists of pure nickel. In principle, the phosphorus content of the electrodeposited nickel-phosphorus alloy may also be less than 12% by weight or more than 15% by weight, but this sometimes has a disadvantageous effect in the context of the invention. The electrodeposited nickel-phosphorus alloy is deposited with the aid of current from an electrolyte bath.

The electrodeposited nickel-phosphorus alloy in the second coating differs from the electrolessly deposited nickel-phosphorus alloy in the first coating in particular with regard to the microstructure and elasticity.

The expression "on the basis of an electrodeposited nickel-phosphorus alloy" means that the electrodeposited nickel-phosphorus alloy forms the main constituent part of the second coating. In this case, it is also possible by all means for the second coating to contain other types of atom and/or chemical compounds in addition to the electrodeposited nickel-phosphorus alloy, which are present in a smaller proportion than the electrodeposited nickel-phosphorus alloy. The proportion of the electrodeposited nickel-phosphorus alloy in the second coating is preferably at least 50% by weight, particularly preferably at least 75% by weight and very particularly preferably at least 95% by weight. It is particularly expedient that, apart from unavoidable impurities, the second coating consists exclusively of an electrodeposited nickel-phosphorus alloy.

It has been found that the doctor blades according to the invention have a high wear resistance and accordingly also a long service life. In this respect, comparative tests have shown that the combination of a first coating consisting of an electrolessly deposited nickel-phosphorus alloy with hard material particles dispersed therein and a second coating on the basis of electrodeposited nickel brings about a positive synergistic effect with regard to the wear resistance. If, for comparative purposes, given a comparable overall layer thickness to the doctor blades according to the invention, doctor blades are provided either only with the first coating (electrolessly deposited nickel-phosphorus alloy with dispersed hard material particles) or only with the second coating (coating on the basis of electrodeposited nickel), this results in considerably lower resistances to wear or service lives than in the case of the doctor blades according to the invention.

Furthermore, the working edges are optimally stabilized by the combination of the first coating consisting of an electrolessly deposited nickel-phosphorus alloy with dispersed hard material particles and the second coating on the basis of electrodeposited nickel. A sharply defined contact zone is therefore provided between the doctor blade and the printing cylinder or the printing roll, and this in turn makes it possible to wipe off printing ink extremely accurately. In this case, the contact zone remains largely stable throughout the printing process.

In addition, it has been found that, during the run-in phase in the printing process, the doctor blades according to the invention do not form any streaks whatsoever or bring about alternative effects which impair the printing process. The doctor blades according to the invention therefore make it possible to obtain a substantially constant printing quality throughout the printing process.

The composition of the second coating on the basis of electrodeposited nickel depends substantially on the intended use of the doctor blade. In this respect, the material and the surface quality of the printing cylinder or of the printing roll play a significant role, for example. A second coating comprising an electrodeposited nickel-phosphorus alloy is generally somewhat harder and more resistant to corrosion than a coating on the basis of electrodeposited nickel, which is substantially free of phosphorus.

It is preferable for at least a lateral surface region of the main body that is present with regard to the longitudinal direction to be covered entirely and all around with the second coating. In this case, at least the working edge, the top side, the bottom side and the rear end face, which is located opposite the working edge, of the main body are covered with the second coating. The side faces of the main body, which are present perpendicularly to the longitudinal direction, may be present in uncoated form. However, it is also within the scope of the invention for the second coating to cover the main body entirely and on all sides, i.e., the side faces of the main body, which are present perpendicularly to the longitudinal direction, are also covered with the second coating. In this case, the second coating therefore surrounds the main body all around.

Since at least the lateral surface region of the main body that is present with regard to the longitudinal direction is covered entirely and all around with the second coating, it is also the case that the essential regions of the main body which do not form part of the working edge and are not covered with the first coating are provided with the second coating. This is advantageous particularly for protecting the main body against the water-based or slightly acidic printing inks and/or other liquids that come into contact with the doctor blade. Particularly in the case of steel base bodies, optimum protection against rust is thereby provided for the doctor blade. The consistency of the printing quality during the printing process is thereby improved further, since the printing cylinder or the printing roll that is in contact with the doctor blade during the printing process is not contaminated by particles of rust, for example. Furthermore, a second coating applied in the lateral surface region provides the main body with the best possible protection against the formation of rust even during storage and/or transport.

If, in addition to the lateral surface region that is present with regard to the longitudinal direction, the side faces of the main body that are present perpendicularly to the longitudinal direction are also covered with the second coating, the quality of the doctor blade is improved further.

In principle, however, it is also possible to cover the main body, apart from the working edge, only partially with the second coating, or even not at all. By way of example, this may be advantageous if the main body is produced, for example, from a stainless steel or another material resistant to printing inks.

In addition, it has proved to be particularly advantageous when hard material particles of SiC and/or $Al_2O_3$ and/or diamond and/or BN are present. In this case, it is also possible for a plurality of hard material particles of different materials to be present at the same time. In this case, the hard material particles preferably have particle sizes of less than 1 μm, in particular of 0.3-0.5 μm. The volume proportion of the hard material particles in the first coating is, in particular, 5-20%. Doctor blades containing such hard material particles are distinguished in particular by an extremely good wear resistance and a long service life. At the same time, however, the use of such hard materials also provides a very sharply defined contact zone between the doctor blade and the printing cylinder or printing roll, with the contact zone remaining substantially constant or stable throughout the service life of the doctor blade.

In principle, it is also possible to provide hard material particles of other materials and with different sizes or volume proportions. In this case, however, the wear resistance and/or the stability of the doctor blade during the printing process is impaired in certain circumstances.

In particular, the phosphorus content of the first coating is 7-12% by weight. In combination with the second coating on the basis of electrodeposited nickel or the second coating on the basis of the electrodeposited nickel-phosphorus alloy, such coatings have proved to be ideal, since both a high wear resistance and also the best possible and constant stability are thereby obtained throughout the service life of the doctor blade.

In principle, however, the phosphorus content of the first coating can also be less than 7% by weight or more than 12% by weight, but the advantageous properties of the doctor blade which are mentioned above are impaired as a result.

The first coating advantageously has a hardness of 750-1400 HV. As a result, the resistance of the doctor blade to wear is increased, in particular. Although hardnesses of less than 750 HV are also possible, the resistance of the doctor blade to wear is reduced. In the case of hardnesses of more than 1400 HV, the printing cylinder or the printing roll may become damaged, as a result of which the printing quality is reduced.

The thickness of the first coating preferably measures 5-30 μm, in particular 7-20 μm. Such thicknesses of the first coating provide the doctor blade according to the invention with optimum wear resistance. Thicknesses of 7-20 μm have proved to be particularly suitable. Although thicknesses of less than 5 μm are possible, the wear resistance is reduced rapidly in this case. Thicknesses of more than 30 μm are also feasible, but these are uneconomical and sometimes have a negative influence on the quality of the working edge.

The thickness of the second coating preferably measures 1-8 μm, in particular 1.5-5 μm. In particular in combination with a first coating having a thickness of 5-30 μm, or preferably 7-20 μm, such thicknesses of the second coating provide the working edge of the doctor blade according to the invention with optimum wear resistance and stability.

In principle, however, the second coating can also have a thickness of less than 1 μm or a thickness of more than 8 μm, but in this case the quality of the working edge is reduced.

If the doctor blade is covered entirely and all around with the second coating, the thickness of the second coating in the region of the working edge is advantageously approximately twice as great as in the region of the center of the broad face of the doctor blade or in a region behind the working edge.

It is preferable for the second coating to comprise a base layer, which adjoins the first coating and consists of pure nickel, and a top layer arranged thereabove, wherein the thickness of the base layer measures 0.2-0.8 μm, in particular 0.4-0.6 μm, and wherein the top layer contains saccharin and/or a saccharin salt. In this case, apart from unavoidable impurities, the base layer consisting of pure nickel preferably consists exclusively of nickel.

A second coating built up in this way firstly has a high degree of adhesion to the first coating and, if appropriate, also to the main body. In addition, owing to the top layer containing saccharin and/or a saccharin salt, the second coating has a very planar surface with a low surface roughness, and this promotes the formation of a sharply defined contact zone between the doctor blade and the printing cylinder or printing rolls.

In principle, however, it is possible in the case of the second coating to dispense with the formation of a base layer and a top layer, and merely to provide a single, substantially homogeneous layer.

In order to produce a doctor blade according to the invention, it is possible, in particular, in a first step, for a first coating on the basis of a nickel-phosphorus alloy with hard material particles dispersed therein to be electrolessly deposited on a working edge region of the doctor blade, which is formed in a longitudinal direction of a flat and elongated main body. In a second step, a second coating on the basis of nickel is deposited by an electroplating process at least on the first coating.

The electroless deposition of the nickel-phosphorus alloy with hard material particles dispersed therein makes it possible to produce a high-quality first coating which, in particular, has a high degree of contour accuracy with respect to the working edge of the doctor blade or with respect to the main body of the doctor blade and also a very uniform layer thickness distribution. In other words, the electroless deposition forms an extremely uniform nickel-phosphorus alloy with hard material particles dispersed therein which follows the contour of the working edge of the doctor blade or the main body in an optimum manner, and this makes a significant contribution to the quality of the doctor blade. Furthermore, the electroless deposition makes it possible to form a first coating which is optimally compatible, in particular, with the second coating on the basis of electroplated nickel to be applied in the second step. This ensures that the second coating adheres sufficiently to the first coating. For the electroless coating, the working edge or, if appropriate, the whole main body of the doctor blade is dipped into a suitable electrolyte bath with hard material particles suspended therein, and is coated in a manner known per se. The hard material particles suspended in the electrolyte bath are incorporated into the nickel-phosphorus alloy during the coating or deposition process and are present in the nickel-phosphorus alloy formed in a substantially randomly distributed manner.

Owing to the electroless deposition of the nickel-phosphorus alloy, it is also possible in principle for plastics to be used as the main body for the doctor blade and to be provided in a simple manner with the first coating consisting of the nickel-phosphorus alloy.

The electroplating process carried out in the second step can be carried out in a manner known per se. In this case, those regions of the doctor blade to be coated, i.e., at least the working edge provided with the first coating, are dipped into a suitable electroplating electrolyte bath, for example. In this process, the regions to be coated act as cathode, whereas a soluble consumable electrode with nickel serves as anode, for example. In principle, however, it is also possible, depending on the material to be deposited, to use insoluble anodes. By applying a suitable electrical voltage between the cathode and anode, an electrical current flows through the electroplating electrolyte bath, as a result of which elemental nickel or, for example, a nickel-phosphorus alloy is deposited on those regions of the doctor blade to be coated and forms the second coating. The second coatings, produced by the electroplating process, are pure and of a high quality. In principle, the quality of the second coating can be improved further by adding additives to the electrolyte bath, which are also incorporated, if appropriate, into the second coating.

Compared with electroless deposition, the electrodeposition of a nickel-phosphorus alloy additionally also has advantages in terms of process engineering. By way of example, the phosphorus content is very readily controllable and the deposition processes can be carried out at high deposition rates. Compared with the electrodeposition of nickel, the electrodeposition of a nickel-phosphorus alloy similarly has the advantage that insoluble anodes can also be used.

It is preferable that, in the second step, during the electroplating process, nickel or, for example, a nickel-phosphorus alloy is electrodeposited on all sides of at least a lateral surface region of the main body that is present with regard to the longitudinal direction, in particular the entire main body. Apart from the fact that the main body of the doctor blade is therefore protected optimally against environmental influences and, in particular, the sometimes chemically aggressive printing inks, the electroplating process in the second step is thereby simplified. By way of example, the main body can be dipped completely into the electrolyte bath. This is not possible when exclusively the working edge provided with the first coating is coated, since the main body then has to undergo complex orientation with respect to the surface of the liquid in the electrolyte bath in certain circumstances.

In principle, however, it is also possible for merely the working edge provided with the first coating to be provided with the second coating.

It is advantageous that, in a third step carried out chronologically after the second step, heat treatment is carried out in order to harden the first coating. The heat treatment induces solid-state reactions in the nickel-phosphorus alloys, which increase the hardness of the nickel-phosphorus alloys. Since the heat treatment is only carried out after the deposition or the application of the second coating, oxide formation is prevented in particular on the surface of the first coating. This firstly entails a high degree of adhesion between the first coating and the second coating, and secondly the uniformity of the doctor blade in the region of the working edge is improved as a whole.

In principle, however, it is also possible to dispense with heat treatment. However, this is at the expense of the wear resistance or service life of the doctor blade produced according to the invention.

In particular, the coated main body is heated to a temperature of 100-500° C., particularly preferably to a temperature of 170-300° C., during the heat treatment. In particular, these temperatures are maintained for a holding time of 0.5-15 hours, preferably 0.5-8 hours. Such temperatures and holding times have proved to be ideal for achieving sufficient hardnesses of the nickel-phosphorus alloys.

Temperatures of less than 100° C. are likewise possible. In this case, however, very long and largely uneconomical holding times are required. Depending on the material of the main body, temperatures of higher than 500° C. are also feasible, in principle, but in this case the hardening process of the nickel-phosphorus alloy is harder to control.

It is advantageous that, during the electroplating process in the second step, firstly a base layer consisting of nickel is deposited at a pH of less than 1.5, in particular at a pH of less than 1, and this is preferably followed by the deposition of a top layer consisting of nickel using saccharin at a pH of 2-5, in particular at a pH of 3.4-3.9.

On account of the acidic conditions, the surface of the working edge to be coated or the surface of the main body is chemically activated, and the base layer forms an extremely stable adhesive bond with the working edge or the main body. The base layer forms an ideal substrate for the top layer to be deposited thereabove. In the process, the observance of a pH value of 2-5 and the use of saccharin result in an optimum top layer with a smooth and planar surface.

In principle, however, the base layer and the top layer can also be deposited under other conditions.

Further advantageous embodiments and combinations of features of the invention will become apparent from the following detailed description and from the totality of the patent claims.

BRIEF DESCRIPTION OF THE ACCOMPANYING DRAWINGS

Figure 2:
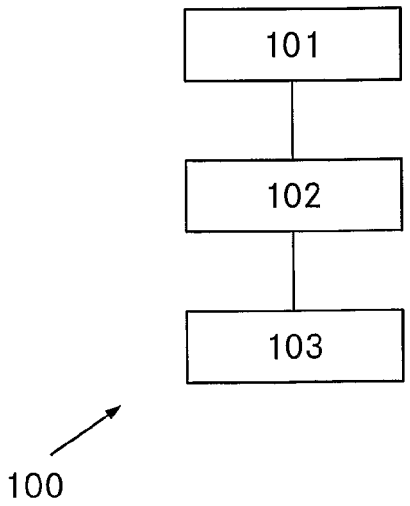

The drawings used to explain the exemplary embodiment show:

FIG. 1 a cross section through a lamellar doctor blade with a two-fold coating in the region of the working edge; and FIG. 2 a schematic illustration of a process for producing a doctor blade.

DETAILED DESCRIPTION OF THE PREFERRED EMBODIMENTS

In principle, identical parts are provided with the same reference signs in the figures.

FIG. 1 shows a lamellar doctor blade 1 according to one embodiment of the invention in cross section. The lamellar doctor blade 1 contains a steel main body 11, which, on the left-hand side in FIG. 1, has a rear region 12 with a substantially rectangular cross section. The thickness of the doctor blade, measured from the top side 12.1 to the bottom side 12.2 of the rear region, is about 0.2 mm. The length of the main body 11 or of the lamellar doctor blade 1, as measured perpendicularly to the plane of the drawing, is 1000 mm, for example.

On the right-hand side in FIG. 1, the main body 11 tapers off in a steplike manner from the top side 12.1 of the rear region 12 in order to form a working edge 13. A top side 13.1 of the working edge 13 lies on a plane below the plane of the top side 12.1 of the rear region 12, but is formed substantially parallel or plane-parallel to the top side 12.1 of the rear region 12. A concavely shaped transition region 12.5 is present between the rear region 12 and the working edge 13. The bottom side 12.2 of the rear region 12 and the bottom side 13.2 of the working edge 13 lie in a common plane, which is formed plane-parallel to the top side 12.1 of the rear region 12 and plane-parallel to the top side 13.1 of the working edge 13. The width of the main body 11, measured from the left-hand end of the rear region to the end face 14 of the working edge 13, measures 40 mm, for example. The thickness of the working region 13, measured from the top side 13.1 to the bottom side 13.2 of the working region, is 0.060-0.150 mm, for example, which corresponds approximately to half the width of the doctor blade in the rear region 12. The width of the working region 13, measured on the top side 13.1 of the working region 13 from the end face 14 to the transition region 12.5, is 0.8-5 mm, for example.

A free end face 14 at the free end of the working edge 13 on the right extends obliquely to the left and downward from the top side 13.1 of the working edge toward the bottom side 13.2 of the working edge 13. In this case, the end face 14 is at an angle of about 45° and 135°, respectively, with regard to the top side 13.1 of the working edge 13 and with regard to the bottom side 13.2 of the working edge 13. A top transition region between the top side 13.1 and the end face 14 of the working edge 13 is rounded off in this case. Similarly, a bottom transition region between the end face 14 and the bottom side 13.2 of the working edge 13 is rounded off.

Furthermore, the working edge 13 of the lamellar doctor blade 1 is surrounded by a first coating 20. In this case, the first coating 20 completely covers the top side 13.1 of the working edge 13, the transition region 12.5 and an adjoining partial region of the top side 12.1 of the rear region 12 of the main body. Similarly, the first coating 20 covers the end face 14, the bottom side 13.2 of the working edge 13 and a partial region, adjoining the bottom side of the working edge 13, of the bottom side 12.2 of the rear region 12 of the main body 11.

By way of example, the first coating 20 consists of a nickel-phosphorus alloy having a phosphorus content of 9% by weight. Hard material particles 20.1 of silicon carbide (SiC) are dispersed therein. The volume proportion of the hard material particles 20.1 is 16%, for example, and the mean particle size of the hard material particles 20.1 is about 0.4 μm. In the region of the working edge 13, the layer thickness of the first coating 20 measures 15 μm, for example, while the hardness is 1200 HV, for example. The layer thickness of the first coating 20 decreases continuously in the region of the top side 12.1 and of the bottom side 12.2 of the rear region 12, such that the first coating 20 peters out in the form of a wedge in a direction away from the working edge 13.

The first coating 20 and the remaining regions of the main body 11 which are not covered by the first coating 20 are surrounded completely by a second coating 21. As a result, the top side 12.1 and the bottom side 12.2 of the rear region 12 and also the rear end face of the main body 11 are also covered with the second coating 21. The lateral surface region of the main body 11 with regard to the longitudinal direction of the main body 11 or of the doctor blade 1, lying perpendicular to the plane of the drawing, is therefore surrounded completely and all around by at least one of the two coatings 20, 21. The front and rear side faces of the main body 11, which lie plane-parallel to the plane of the drawing and are not visible in FIG. 1, can likewise be covered with the second coating 21.

The second coating 21 consists of a base layer 21.1, which consists of electrodeposited pure nickel and has a layer thickness of about 0.5 μm. A top layer 21.2 is arranged above the base layer 21.1. The top layer 21.2 likewise consists of an electrodeposited pure nickel, but this is additionally mixed with saccharin.

In the region of the working edge 13, the layer thickness of the second coating 21, i.e., the layer thickness of the base layer 21.1 and the layer thickness of the top layer 21.2 together, is 4 μm, for example, whereas the layer thickness in the rear region 12 measures 2 μm, for example.

FIG. 2 schematically shows a process 100 for producing a lamellar doctor blade, as shown in FIG. 1 for example. In this process, in a first step 101, the working edge 13 of the main body 11, which is to be coated with the nickel-phosphorus alloy or the first coating 20, is dipped, for example, into a suitable aqueous electrolyte bath, known per se, with hard material particles 20.1 suspended therein, wherein nickel ions from a nickel salt, e.g., nickel sulfate, are reduced by a reducing agent, e.g., sodium hypophosphite, in an aqueous environment to form elemental nickel and are deposited on the working edge 13, with the formation of a nickel-phosphorus alloy and the simultaneous embedding of the hard material particles 20.1. This takes place without the application of an electrical voltage or completely electrolessly under moderately acidic conditions (pH 4-6.5) and at elevated temperatures of 70-95° C., for example.

In a second step 102, firstly a first electroplating electrolyte bath on an aqueous basis containing nickel chloride and hydrochloric acid at a pH of about 1 is provided, for example. Then, the main body 11 with the first coating 20 already applied in the first step is dipped completely into the electrolyte bath, and a base layer 21.1 of the second coating 21 is deposited in a manner known per se using externally supplied electrical current. Then, in a second electroplating electrolyte bath on an aqueous basis containing nickel, nickel sulfate, nickel chloride, boric acid and saccharin at a pH of 3.7, a top layer 21.1 is deposited in a manner known per se.

In a third step 103, the main body 11 provided with the first coating 20 and the second coating 21 is fed for heat treatment over the course of two hours, for example, and at a temperature of 300° C. Finally, the finished lamellar doctor blade 1 is cooled and is thus ready for use.

Tests have shown that the lamellar doctor blades 1 shown in FIG. 1 have a very high wear resistance and stability throughout their service life. For comparison purposes, a main body identical to that of the lamellar doctor blade 1 shown in FIG. 1 was provided merely with a first coating 20 in a first comparative test, with the application of a second coating being dispensed with. In a second test, a main body identical to that of the lamellar doctor blade 1 shown in FIG. 1 was provided only with a second coating 21 having a layer thickness comparable to that of the first coating from the first test, but with the application of a first coating being dispensed with. In this case, both lamellar doctor blades produced for the tests had lower wear resistances and service lives compared to the lamellar doctor blade 1 shown in FIG. 1.

The embodiment and the production process described above are to be understood merely as illustrative examples, which can be modified as desired within the scope of the invention.

By way of example, the main body 11 shown in FIG. 1 may also be produced from a different material, e.g., stainless steel or a carbon steel. In this case, it may be advantageous for economical reasons to apply the second coating 21 merely in the region of the working edge 13, in order to reduce the consumption of material for the coating. In principle, however, the main body 11 can also consist of a non-metallic material, e.g., plastics. This may be advantageous, in particular, for applications in flexographic printing.

However, it is also possible to use a main body having a different shape instead of the main body 11 shown in FIG. 1. In particular, the main body may have a wedge-shaped working edge or a non-tapered cross section with a rounded-off working edge. The free end face 14 at the free end of the working edge 13 on the right may also have a completely rounded-off shape, for example.

Furthermore, the doctor blade according to the invention shown in FIG. 1 can also have different dimensions. Thus, by way of example, the thickness of the working region 13, measured from the top side 13.1 to the bottom side 13.2 of the working region, may vary in a range of 0.040-0.200 mm.

Similarly, the first coating 20 shown in FIG. 1 may contain further alloy components and/or additional substances, e.g., metal atoms, nonmetal atoms, inorganic compounds and/or organic compounds.

Other hard material particles can also be present instead of or in addition to the hard material particles of silicon carbide (SiC).

Further substances, e.g., metal atoms, nonmetal atoms, inorganic compounds and/or organic compounds, can be added in the second coating 21, both in the base layer 21.1 and in the top layer 21.2.

It is additionally also within the scope of the invention to omit the base layer 21.1 of the second coating 21 and, for example, to make the top layer 21.2 thicker. It is likewise possible to dispense with the saccharin in the top layer 21.2 or to replace it with another substance having the same effect.

It is also possible for further layers on the basis of electroplated nickel to be present in addition to or instead of the base layer 21.1 and/or the top layer 21.2 of the second coating 21 shown in FIG. 1. This may be advantageous, in particular, for the adaptation of the properties of the doctor blade according to the invention to specific requirements.

Furthermore, it is possible to provide an electrodeposited nickel-phosphorus alloy having a phosphorus content of preferably 12-15% for the second coating 21, instead of electrodeposited pure nickel. It is thereby possible, in particular, to increase the hardness of the second coating, which may be advantageous depending on the intended use.

In summary, it can be stated that a novel doctor blade design has been found, which guarantees a high service life and quality of the doctor blade and, in particular, makes more economical printing processes possible.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A doctor blade, in particular for doctoring off printing ink from a surface of a printing form, comprising a flat and elongated main body having a working edge region formed in a longitudinal direction, wherein the working edge region is covered with a first coating on the basis of an electrolessly deposited nickel-phosphorus alloy, and wherein hard material particles are dispersed in the first coating, wherein the first coating is covered with a second coating on the basis of electrodeposited nickel, thereby providing said first coating of nickel-phosphorus alloy covered by said second coating of nickel that is substantially free of phosphorus and wherein said second coating comprises a base layer, which adjoins the first coating and consists essentially of pure nickel, and a top layer arranged thereabove, wherein the thickness of the base layer measures 0.2-0.8 μm and wherein the top layer contains at least one of a saccharin or a saccharin salt.

2. The doctor blade as claimed in claim 1, wherein at least a lateral surface region of the main body that is present with regard to the longitudinal direction is covered entirely and all around with the second coating.

3. The doctor blade as claimed in claim 1, wherein the hard material particles of SiC and/or Al2O3 and/or diamond and/or cubic BN are present.

4. The doctor blade as claimed in claim 1, wherein the phosphorus content of the first coating is 7-12% by weight.

5. The doctor blade as claimed in claim 1, wherein the first coating has a hardness of 750-1400 HV.

6. The doctor blade as claimed in claim 1, wherein the thickness of the first coating measures 5-30 μm.

7. The doctor blade as claimed in claim 1, wherein the thickness of the second coating measures 1-8 μm.

8. The doctor blade as claimed in claim 1, wherein the thickness of the first coating measures 7-20 μm.

9. The doctor blade as claimed in claim 1, wherein the thickness of the second coating measures 1.5-5 μm.

10. The doctor blade as claimed in claim 1, wherein the second coating comprises a base layer, which adjoins the first coating and consists of pure nickel, and a top layer arranged thereabove, wherein the thickness of the base layer measures 0.4-0.6 μm, and wherein the top layer contains at least one of a saccharin or a saccharin salt.

11. A process for producing a doctor blade, comprising the steps of electrolessly depositing a first coating on the basis of a nickel-phosphorus alloy with hard material particles dispersed therein on a working edge region of the doctor blade, which is formed in a longitudinal direction of a flat and elongated main body, and electroplating a second coating on the basis of nickel at least on the first coating using an electroplating process at least on the first coating wherein during the electroplating process in the second step, firstly a base layer consisting essentially of nickel is deposited at a pH of less than 1.5 and in that this is followed by the deposition of a top layer consisting of nickel using saccharin at a pH of 2-5.

12. The process as claimed in claim 11, wherein in a second step, during the electroplating process, nickel is deposited on all sides of and all around at least a lateral surface region of the main body that is present with regard to the longitudinal direction, in particular the entire main body.

13. The process as claimed in claim 11, wherein in a third step carried out chronologically after the second step, heat treatment is carried out in order to harden the first coating and/or the second coating.

14. The process as claimed in claim 11, wherein the coated main body is heated to a temperature of 100-500° C. during the heat treatment.

15. The process as claimed in claim 11, wherein the coated main body is heated to a temperature of 170-300° C. during the heat treatment.

16. The process as claimed in claim 11, wherein during the electroplating process in the second step, firstly a base layer consisting of nickel is deposited at a pH of less than 1, and in that this is followed by the deposition of a top layer consisting of nickel using saccharin at a pH of 3.4-3.9.

17. A doctor blade, in particular for doctoring off printing ink from a surface of a printing form, comprising a flat and elongated main body having a working edge region formed in a longitudinal direction, wherein the working edge region is covered with a first coating on the basis of an electrolessly deposited nickel-phosphorus alloy, and wherein hard material particles are dispersed in the first coating, wherein the first coating is covered with a second coating on the basis of electrodeposited nickel, thereby providing said first coating of nickel-phosphorus alloy covered by said second coating of nickel that comprises a nickel-phosphorus alloy, wherein said second coating comprises a base layer, which adjoins the first coating and consists essentially of pure nickel, and a top layer arranged thereabove, wherein the thickness of the base layer measures 0.2-0.8 μm, and wherein the top layer contains at least one of a saccharin or a saccharin salt.

18. The doctor blade as claimed in claim 17, wherein the electrodeposited nickel-phosphorus alloy has a phosphorus content of 12-15%.

19. The doctor blade as claimed in claim 17, wherein at least a lateral surface region of the main body that is present with regard to the longitudinal direction is covered entirely and all around with the second coating.

20. The doctor blade as claimed in claim 17, wherein the hard material particles of SiC and/or Al2O3 and/or diamond and/or cubic BN are present.

21. The doctor blade as claimed in claim 17, wherein the phosphorus content of the first coating is 7-12% by weight.

22. The doctor blade as claimed in claim 17, wherein the first coating has a hardness of 750-1400 HV.

23. The doctor blade as claimed in claim 17, wherein the thickness of the first coating measures 5-30 μm.

24. The doctor blade as claimed in claim 17, wherein the thickness of the second coating measures 1-8 μm.

25. The doctor blade as claimed in claim 17, wherein the thickness of the first coating measures 7-20 μm.

26. The doctor blade as claimed in claim 17, wherein the thickness of the second coating measures 1.5-5 μm.

27. The doctor blade as claimed in claim 17, wherein the second coating comprises a base layer, which adjoins the first coating and consists of pure nickel, and a top layer arranged thereabove, wherein the thickness of the base layer measures 0.4-0.6 μm, and wherein the top layer contains at least one of a saccharin or a saccharin salt.

* * * * *

UNITED STATES PATENT AND TRADEMARK OFFICE

CERTIFICATE OF CORRECTION

PATENT NO. : 9,044,927 B2
APPLICATION NO. : 13/121432
DATED : June 2, 2015
INVENTOR(S) : Brudermann et al.

It is certified that error appears in the above-identified patent and that said Letters Patent is hereby corrected as shown below:

ON THE TITLE PAGE

Item (73) Please delete "Daetwyler SwissTech AG" and insert -- Daetwyler SwissTec AG -- therefor.

Signed and Sealed this
Twenty-fourth Day of November, 2015

Michelle K. Lee

Michelle K. Lee
*Director of the United States Patent and Trademark Office*